US006626303B1

(12) United States Patent
Moodie

(10) Patent No.: US 6,626,303 B1
(45) Date of Patent: Sep. 30, 2003

(54) MAGNETIC PRESENTATION AND DISPLAY BOARD

(76) Inventor: Peter Moodie, 22 Greenhaven Way, Centerport, NY (US) 11721

( * ) Notice: Subject to any disclaimer, the term of this patent is extended or adjusted under 35 U.S.C. 154(b) by 0 days.

(21) Appl. No.: 10/285,962

(22) Filed: Nov. 2, 2002

Related U.S. Application Data

(60) Provisional application No. 60/335,558, filed on Nov. 28, 2001.

(51) Int. Cl.[7] ..... A47F 7/00
(52) U.S. Cl. ..... 211/70.7
(58) Field of Search ..... 211/70.7, DIG. 1; 248/683, 37.3, 37.6, 206.5

(56) References Cited

U.S. PATENT DOCUMENTS

| | | | | | |
|---|---|---|---|---|---|
| 361,248 | A | * | 4/1887 | Winton | 335/285 |
| 1,531,070 | A | | 3/1925 | Bruns | |
| 2,474,036 | A | * | 6/1949 | Curley | 335/285 |
| 2,966,992 | A | * | 1/1961 | Dunkelberger et al. | 211/70.7 |
| 3,490,601 | A | * | 1/1970 | Hain et al. | 312/248 |
| 3,716,935 | A | | 2/1973 | Friedrichs | 40/142 A |
| 3,776,387 | A | * | 12/1973 | Brent | 211/70.6 |
| 3,942,147 | A | | 3/1976 | Josephson | 335/285 |
| 4,183,439 | A | * | 1/1980 | Bell | 211/70.7 |
| 4,251,936 | A | | 2/1981 | Ferrell | 40/489 |
| 4,497,412 | A | * | 2/1985 | Labelle | 211/70.7 |
| 4,544,067 | A | * | 10/1985 | Miller | 211/70.6 |
| 4,826,059 | A | * | 5/1989 | Bosch et al. | 224/183 |
| 5,011,102 | A | * | 4/1991 | Kiefer | 248/37.3 |
| 5,384,999 | A | | 1/1995 | Roche et al. | 52/764 |
| 5,553,724 | A | | 9/1996 | Moher et al. | 211/70.7 |
| 5,639,138 | A | * | 6/1997 | Smith | 294/142 |
| 5,725,096 | A | * | 3/1998 | Winnard | 206/350 |
| 6,182,387 | B1 | | 2/2001 | Duguay | 40/621 |
| 6,360,464 | B1 | | 3/2002 | Tate | 40/621 |

* cited by examiner

*Primary Examiner*—Alvin Chin-Shue
*Assistant Examiner*—Sarah Purol
(74) *Attorney, Agent, or Firm*—Island Patent; F. Scott Tierno

(57) ABSTRACT

A magnetic presentation and display board arranged for securely, yet removably displaying at least one display article in a pre-determined display location. The magnetic presentation and display board includes a presentation board formed of non-ferromagnetic materials. The presentation board may be structured having a core with a number of magnet receptacles. At least two magnet pairs are included for each display article to be displayed upon the presentation board. Each magnet pair includes an article magnet and a board magnet. Each article magnet is fixed for display purposes only to a rear facing surface of the respective display article at a pre-selected location. Each corresponding board magnet is embedded within the core of the presentation board, such that each board magnet will align with and be magnetically attracted to an aligned article magnet when the display article is positioned in the pre-selected display location. Such an alignment of board magnets with article magnets thereby causing the display article to be magnetically held in position by each provided magnet pair, causing the display article to be securely, yet removably displayed.

19 Claims, 6 Drawing Sheets

MAGNETIC PRESENTATION AND DISPLAY BOARD

CROSS REFERENCE TO RELATED APPLICATION

The subject matter contained herein is related to provisional patent application Ser. No. 60/335,558 filed on Nov. 28, 2001, which is hereby incorporated by reference.

TECHNICAL FIELD

The present invention relates most generally to presentation and display boards. More particularly, the invention relates to a magnetic presentation and display board for securely, yet removably displaying at least one display article in a pre-determined display location upon a first display surface thereof. Most preferred embodiments support the displaying of a plurality of articles, while also providing for an inherent positional keying of at least a plurality of the articles being displayed.

BACKGROUND ART

The need to present and display items for sale is well appreciated by retailers, store owners, marketing entities, sales persons, etc. Indeed, it is well accepted, that the respective sales levels for an item or article may be significantly affected by the type of packaging, as well as the nature and structure of a sales display used to present the article for sale at commercial locations.

Certain articles can be more difficult to display than others, with smaller items being a particular challenge. When considering the displaying and presenting of items or articles that come in groups or sets, additional concerns and considerations come into play. For example, consider a need to display placements of flatware and or sets of knives. These items present particular challenges when attempting to provide a secure, yet removable displaying mechanism. In addition, unlike commonly used display arrangements, such as those employing hook and eye tape, or mechanical clips and retainers, it would be most desirable to provide a clean and neat display arrangement, which inherently causes displayed articles that are momentarily removed from a presentation board of the invention to be placed back in an original location.

When there is a need for a simple and plain background against which the items and articles are to be clearly displayed, including backgrounds not having cutouts, indentations, and outlines, the prior art has yet to provide a simple structure with high aesthetic properties. In addition, the prior art does not provide a configurable and fully functional magnetic presentation and display apparatus having the structure, features and characteristics provided by the present invention.

Therefore, skilled individuals will certainly appreciate a need for new and improved presentation and display structures employing suitable means for firmly, yet removably displaying one or more display articles upon a presentation board. Additionally, there is a need for a presentation and display arrangement wherein a plurality of display articles may be displayed, with each displayed article having an inherent positional keying establishing a unique display location. As such, if several displayed articles or items are removed from the presentation board of the invention, each will preferably have to be placed back in their original position in order to be properly fixed to the presentation board. A number of other characteristics, advantages, and or associated novel features of the present invention, will become clear from the description and figures provided herein. Attention is called to the fact, however, that the drawings are illustrative only. In particular, the embodiments included and described, have been chosen in order to best explain the principles, features, and characteristics of the invention, and its practical application, to thereby enable skilled persons to best utilize the invention and a wide variety of embodiments providable that are based on these principles, features, and characteristics. Accordingly, all variations possible are contemplated as being part of the invention, limited only by the scope of the appended claims.

SUMMARY OF THE INVENTION

In accordance with the present invention, a magnetic presentation and display board is provided for securely, yet removably displaying at least one display article in a pre-determined or pre-selected display location upon a first surface of the board. Included is a presentation board preferably formed of non-ferromagnetic materials, including a first sheet material establishing a typically planar first surface, and a core to which the first sheet material is fixed. The core is structured with a plurality of magnet receptacles, which in their simplest embodiment are specifically sized through-holes.

The invention further calls for at least two magnet pairs to be included for the mounting or holding of each display article to be displayed upon the presentation board. Each magnet pair includes an article magnet and a board magnet. The article magnet is fixed for display purposes (subsequent to manufacture), to a rear facing surface of a respective display article at a determined or pre-selected location. The board magnet of each magnet pair is embedded within a magnet receptacle of the core of the presentation board, and preferably located substantially directly behind the first sheet material, or an equivalent structure, so as to be hidden from view. Importantly, each board magnet is located within a selected magnet receptacle such that the board magnet will align with (superpose) and be magnetically attracted to a respective article magnet of the magnet pair when the display article is substantially positioned in a pre-established display location. It may be noted, as indicated in the included figures and descriptions provided hereinafter, that a display location of a display article is established by suitably locating the board magnets, as required, so that the associated display article is positioned in a desired location upon the presentation board of the invention. Accordingly, a preselected position or location at which an article is to be displayed may be established or altered by simply moving each board magnet of the magnet pairs associated with the display article, while maintaining a relative spacing, as required by the spacing of the article magnets.

Accordingly, it should be understood that the displaying of each display article is effected by a plurality of paired magnets. As a result, each display article is securely, yet removably held and displayed upon a suitable presentation board, when the display article is in an intended display location. This secure, yet removable displaying of a display article upon the presentation board results from an article magnet and a board magnet (of each magnet pair) being substantially aligned and in a superposing arrangement. Therefore, for each magnet pair provided, an article magnet is closely spaced from a board magnet when the display article is in an intended display location. This closely spaced alignment of the magnets, which may actually vary with the size and type of magnets employed, causes a nearly maximum magnetic attraction to be exerted between the respective article and board magnets of each magnet pair.

Another feature of the present invention provides for embodiments wherein a plurality of display articles may be displayed. These embodiments of the magnetic presentation and display board may be structured and configured such that each display article is displayed with at least two magnet pairs, and the magnet pairs of each item displayed are arranged to have a different relative spacing. As such, these possibly most preferred embodiments of the magnetic presentation and display board are structured for displaying a plurality of the display articles in a unique position, with each desired display location established by uniquely spacing each of the plurality of magnet pairs used for displaying each respective display article. Accordingly, these latter embodiments inherently reduce or eliminate the possibility of placing one or more display articles in improper display location, due to a noticeable miss-aligning of the magnets of at least one magnet pair when a display article is placed in an incorrect display location.

BRIEF DESCRIPTION OF THE DRAWINGS

In the drawings, like elements are assigned like reference numerals. The drawings are not necessarily to scale, with the emphasis instead placed upon the principles and or features of the present invention. Additionally, each of the embodiments depicted are but one of a number of possible arrangements utilizing the fundamental concepts of the present invention. The drawings are briefly described as follows.

PARTIAL LIST OF REFERENCE NUMERALS

10—magnetic presentation and display board
12—presentation board
12*a*—first (front) sheet material
12*b*—core of 10
12*c*—second (back) sheet material
16—display article(s) (generalized)
16*a*–16*e*—display articles (individual)
16*ea*—front facing surface of 16e
16*eb*—rear facing surface of 16e
20—double sided foam tape
24—article magnet or element
24*a*—first article magnet
42*b*—second article magnet
25*a*—first board magnet
25*b*—second board magnet
26—magnet pair
28—magnet receptacle
28*a*—threaded magnet receptacle
30—threaded magnet housing or casing
30*a*—threading of 30
34—slot
36—information tag or tag holder
114—slidably removable rear cover

DETAILED DESCRIPTION AND MODES OF THE INVENTION

It is important to establish the definition of a number of descriptive terms and expressions that will be used throughout this disclosure. The expression "magnetic presentation and display board" may, based on the context in which it is employed, be considered equivalent to the terms 'display board', 'magnetic presentation board', and most generally 'board'. It may also be noted that a 'presentation board' of the invention is a main or major component of the magnetic presentation and display board that is disclosed and claimed herein. The term 'display article' is to be understood to be any item or article, to which a magnet may be fixed to a rear facing surface, for displaying and presenting in accordance with the present invention. As such, display articles may include numerous cutlery items, a variety of hand tools, small instruments, and a large plurality of other possible articles/items. Other important terms and definitions will be provided hereinafter, as they are needed, to properly and concisely define the present invention and its associated novel characteristics and features.

Figure 1:
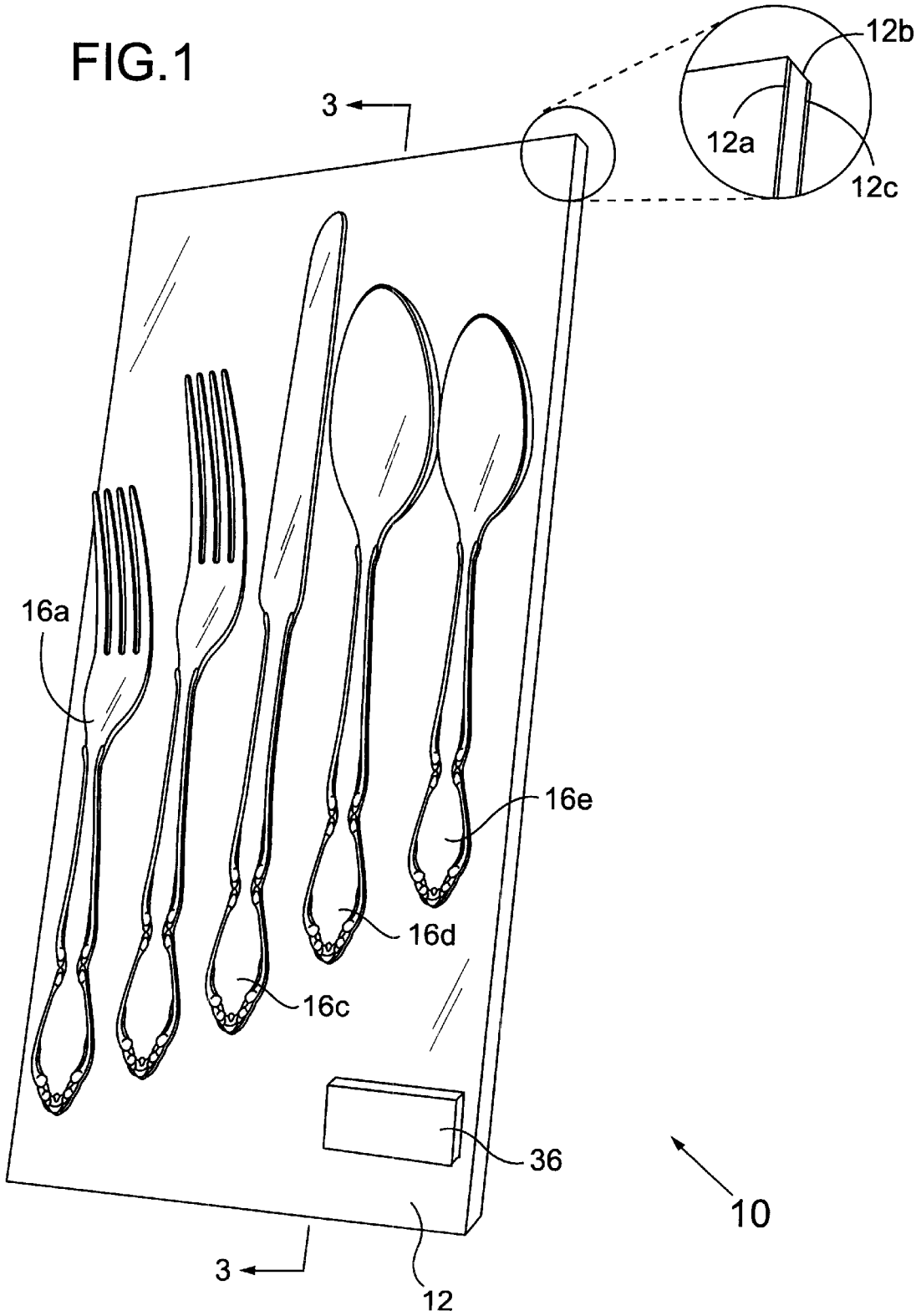
FIG. 1 provides a perspective view of an embodiment of a magnetic presentation and display board in accordance with the present invention, and further provides an expanded partial view of the construction of a presentation board thereof.

Referring now to the drawings, FIG. 1 provides a perspective view of a first embodiment of the invention. As shown the magnetic presentation and display board 10 is structured to display and present at least one display article 16 in a pre-determined display location upon a first surface of a presentation board 12. It may be noted that for convenience a single display article, or a plurality of display articles, including display articles 16*a* through 16*e*, may be collectively referred to as display article(s) 16. As illustrated, the display articles 16 are each mounted or fixed to the magnetic presentation board 12 so that each display article 16 is securely, yet removably displayed upon the presentation board 12. For example, in most embodiments the "secure, yet removable displaying" of a display article may require a force of 3 to 20 pounds to be applied in order to free a display article 16 from a presentation board 12 of the invention for inspection (when mounted and displayed in an established display location). Importantly, the actual force of attraction that must be overcome to free a display article that is "securely, yet removably displayed" upon the magnetic presentation and display board of the invention can vary considerably with any of a number of reasons, including any of the following:

a) the number of board and article magnet pairs employed for displaying a respective display article (e.g., 2, 3, etc.);
b) the type, size, geometry, and shape of the permanent magnets utilized for the board and article magnets;
c) the thickness of the first sheet material 12*a* fixed to the core 12*b*; and
d) if the magnetic receptacles 28 are not provided by the preferred through holes, the depth of the bores provided in the core 12*b* that establish each magnetic receptacle 28.

Figure 2:
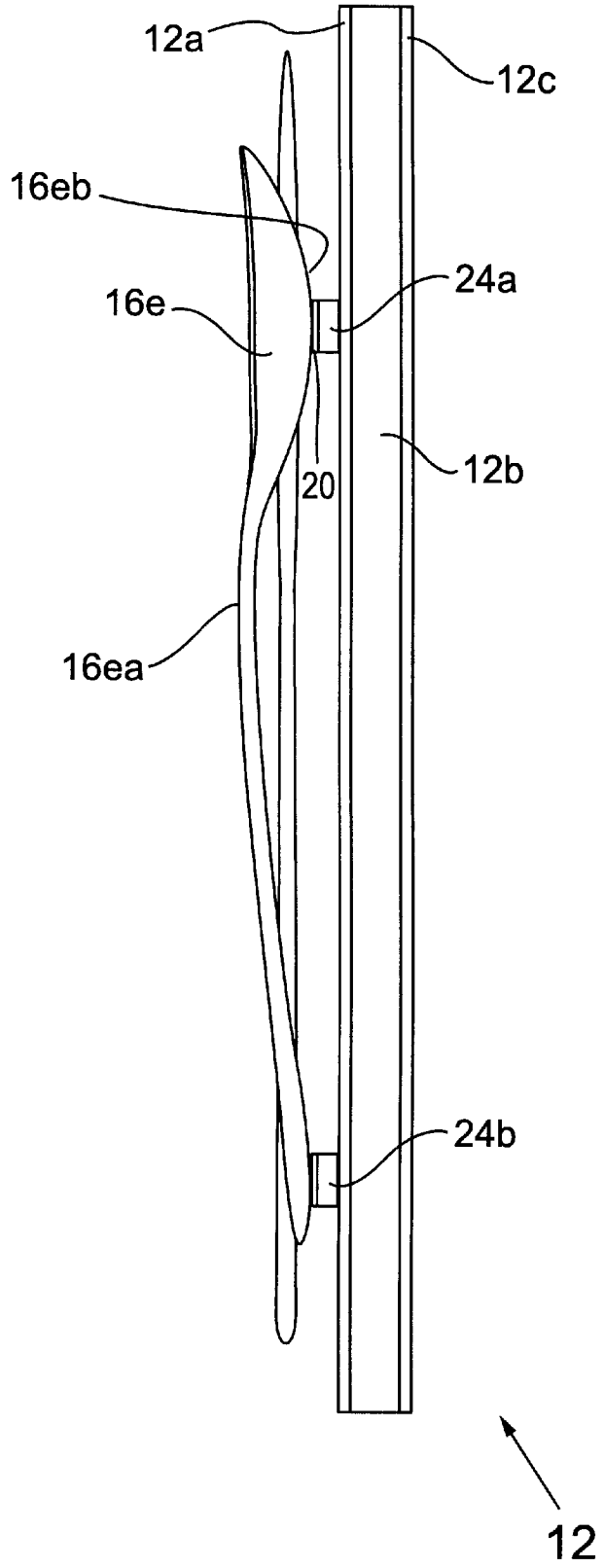
FIG. 2 is a side view of an embodiment of the presentation and display board taken in the direction of line 3—3 of FIG. 1, depicting and possibly over emphasizing a preferred laminated structure for the magnetic presentation and display board of the invention.
Figure 3:
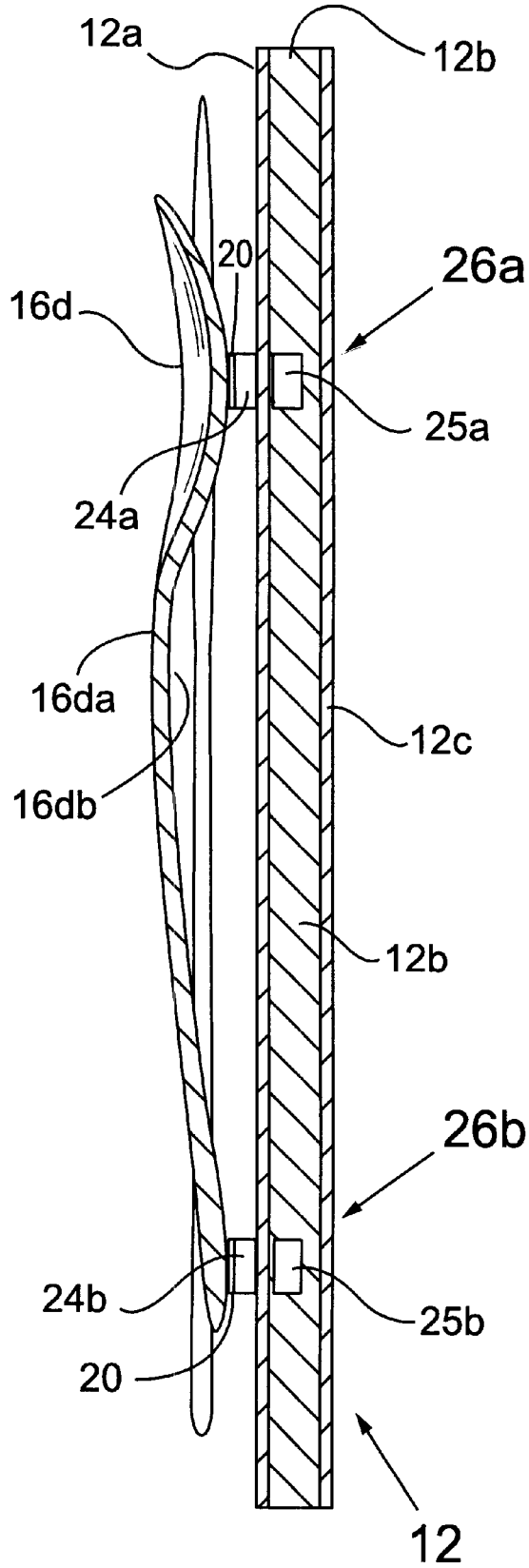
FIG. 3 illustrates a sectional side view of the embodiment of FIG. 1 taken along the line 3—3.

As can be seen in FIGS. 1 through 3 the presentation board 12 may most preferably be formed of lamination of non-ferromagnetic materials. A first sheet or sheet material 12*a* may be included for establishing the first (presentation) surface. Also included is a core 12*b*. The first sheet material 12*a* superposes the core 12*b* on a first side or surface, and is fixed to the core 12*b* thereat. A second sheet material 12*c*, when included, is preferably fixed to an opposite/back side of the core 12*b*, as shown. Further provided with embodiments of the invention are at least two magnet pairs 26. For example, as best depicted in FIGS. 2 and 3, a first magnet pair is included and composed of an article magnet 24*a*, which may be generically termed an article magnet 24, and a superposed board magnet 25*a*, which may be generically termed a board magnet 25. This magnet pair will be designated 26*a*. Similarly a second magnet pair 26*b* is provided by the article magnet 24*b* and a display magnet 25*b* (as best seen in FIG. 3).

As can be clearly seen in FIG. 1, additional items may be provided that are mountable upon the presentation board 12, possibly via a magnetic arrangement. For example, an information tag or tag holder 36 may be included for prominently displaying information such as model number, key features, pricing information, etc.

It should be understood that the article magnets 24, such as 24*a* and 24*b* shown in FIGS. 2 and 3, are each fixed for 'display purposes only' to a rear facing surface of a respective display article 16. Therefore, the article magnets 24 are not generally a portion of the actual display article 16, and are preferably not sold to the customer when an article is purchased. In most contemplated venues, the present invention would require the attaching of the article magnets to the articles to be displayed. As illustrated, an exemplary manner of mounting magnets 24*a* and 24*b*, may be to employ a double sided foam tape 20. A most preferred double sided tape 20 would be a high-tack foam tape, say with a thickness of approximately 1 millimeter (mm). Importantly, the particular type of fixing means (e.g., tape, glue, etc.) used to fix the article magnets to the rear surface of a display article must be able to withstand the pulling and separating of the display article from the presentation board, possibly many many times.

As illustrated in FIGS. 1 through 3, it is most desirable to mount each display article 16 in a secure, yet removable manner, so that a customer may actually remove a display article 16 from the presentation board 12 for closer inspection and examination. In addition, it will certainly be possible that the customer may desire to remove a plurality of the display articles 16 from the presentation board 12 for examination. Accordingly, there is a potential for the customer to replace display articles 16 in incorrect display locations. Skilled individuals will therefore appreciate a desire to make it apparent to a respective customer when a display article 16 has been placed in an unintended display location. As such, another feature of preferred embodiments of the magnetic presentation and display board 10 provides a simple structure for supporting the displaying of each of the display articles 16 in a unique position, which may be termed a unique 'display location'. Each unique display location is established by uniquely spacing the plurality of magnet pairs 26 used for displaying each display article 16. That is, for each article magnetically held and displayed upon the presentation board 12, a uniquely spaced plurality of magnet pairs 26 is provided. Should a display article be located in an incorrect display location, an improper or insecure mounting of the display article 16 results. As understood by skilled individuals, when improperly located upon the presentation board 12, there will be a mis-aligning of one or more magnet pairs 26, providing an insufficient holding force for securely and properly displaying the display article on the presentation board 12 in accordance with the present invention.

Figure 4:
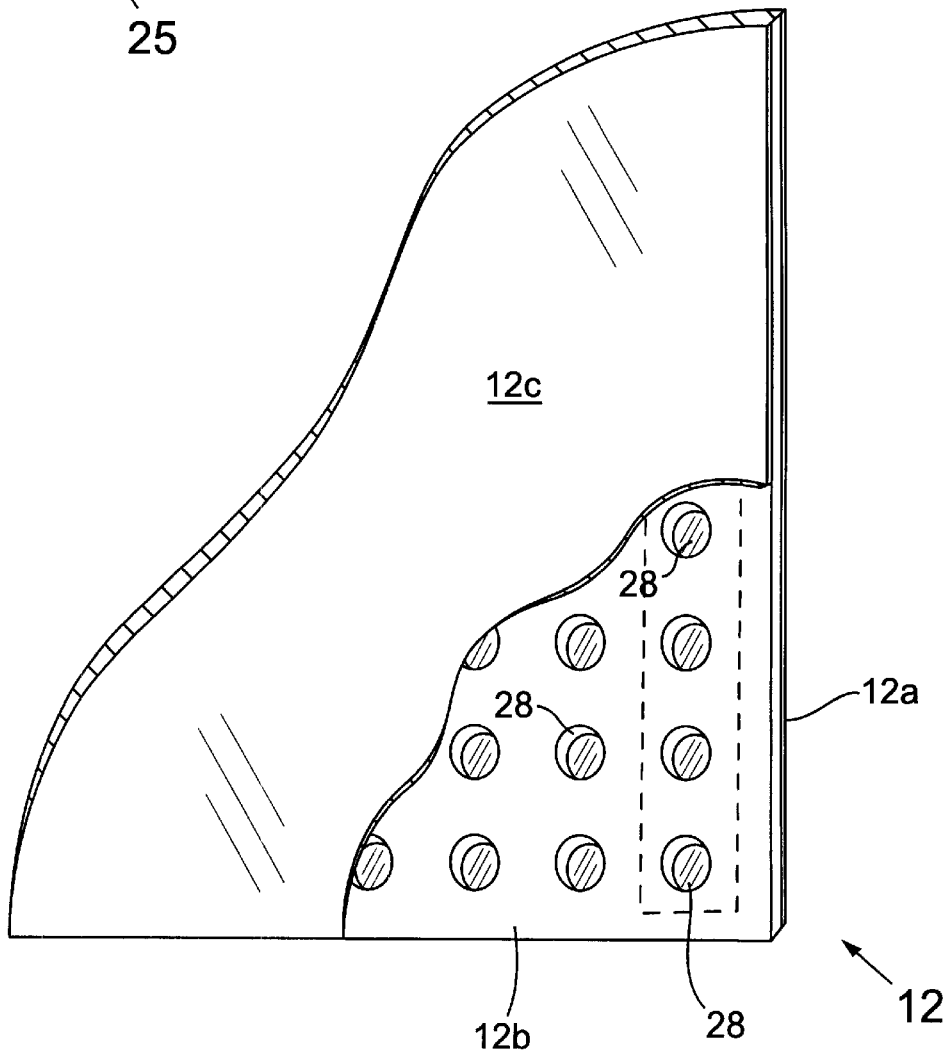
FIG. 4 provides a rear, partially cut-away view of a first embodiment of a configurable presentation board of the invention consistent with FIGS. 1 through 3.
Figure 5:
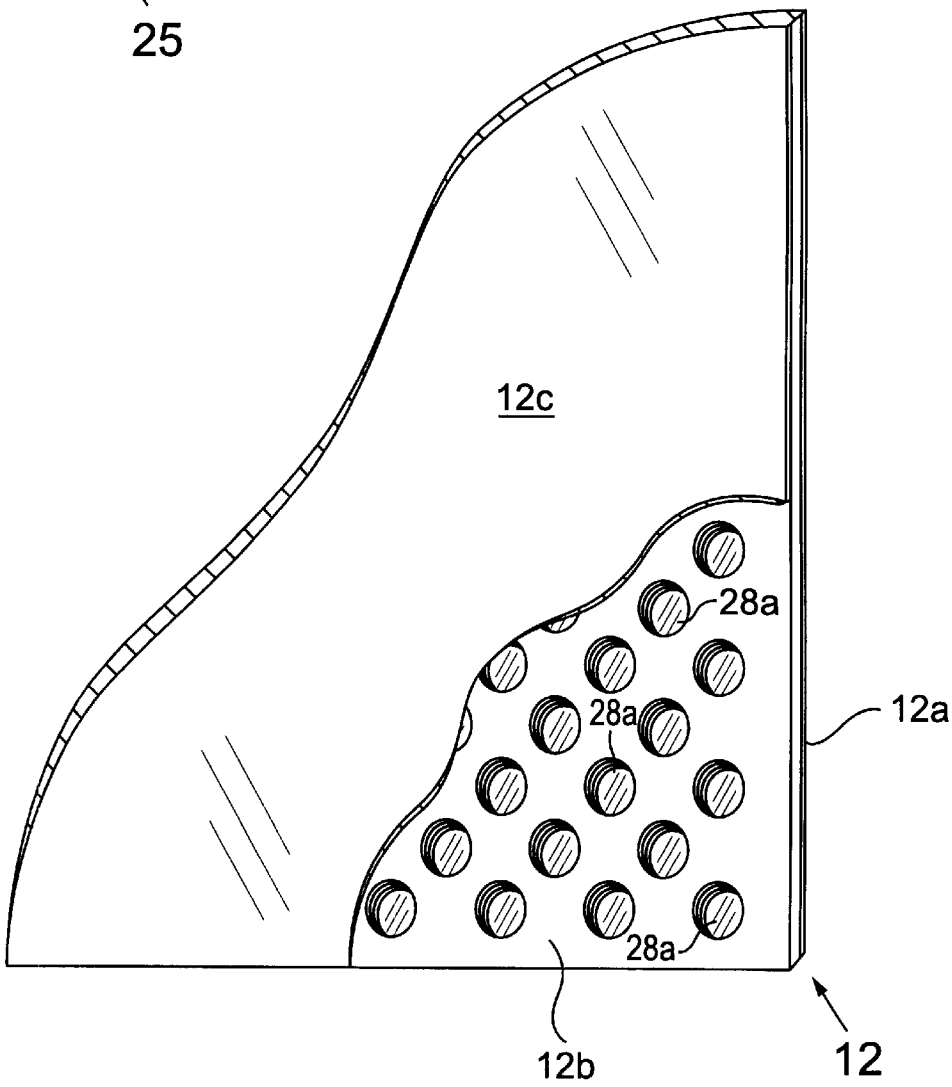
FIG. 5 provides a rear, partially cut-away view of another embodiment of a configurable presentation board, which is also consistent with FIGS. 1 through 3.

Turning now to FIGS. 4 and 5, depicted therein are other preferred embodiments of the invention 10. Each figure provides a partial cut-away view of an embodiment of a modified of the invention having a modified core 12*b*. As shown, each core 12*b* is structured with a plurality of magnet receptacles 28/28*a*. Each magnet receptacle is sized to accept a board magnet 25, such as board magnets 25*a* and 25*b*. As clearly shown, it is contemplated that a large plurality of magnet receptacles 28/28*a* may be provided, as required, in a variety of arrangements, including in a grid arrangement (as seen in FIG. 4) and a honeycomb arrangement (as seen in FIG. 5). Other configurations and arrangements of magnet receptacles 28/28*a* are certainly providable by skilled persons. Importantly, the most preferred arrangements of magnet receptacles 28/28*a* results in a fully configurable magnetic presentation and display board 10 of the invention, wherein a unique spacing may be readily established between the magnet pairs 26 employed for mounting each respective display article 16. As discussed, herein this may result in each display location for each display article 16 being uniquely defined via a unique spacing of the board magnets 25 associated with that display location.

Returning to FIG. 4, the magnet receptacles 28 illustrated therein are contemplated as preferably having a diameter selected to enable the board magnets 25 to be embedded and held within the core 12*b*. In order to maximize the attractive force between magnets 24/25 of each magnet pair 26, it would be desirable to structure the core 12*b* and or the magnets 25, such that each board magnet will be embeddable into the core 12*b* such that at least a portion of the board magnets are positioned so as to be substantially or effectively superposed by an inner surface of first sheet material 12*a*. Accordingly, when an article magnet 24 is positioned in close proximity to a corresponding and properly aligned board magnet, a substantial magnetic attraction will be exerted between the magnets of the magnet pair and the display article 16 will be held mounted upon the presentation board 12 in a firm and secure, yet removable fashion.

The structures of FIG. 4 and FIG. 5, and equivalents thereto, enable the spacing between magnet pairs 26 to be established, as required, so as to:

a) provide a unique spacing between each magnet pair 26 employed to mount and display a respective display article 16 upon the presentation board 12;

b) enable items having a very different length or size to be firmly mounted upon the presentation board 12 in accordance to the invention; and c) enable magnetic presentation and display boards 10 of the invention to be configured or reconfigured by simply adding, removing, or relocating one or more board magnets. This feature will be helpful in adapting the invention for the presenting and displaying of a large variety of display articles 16 having significantly differing sizes, shapes, and structures.

Figure 6A:
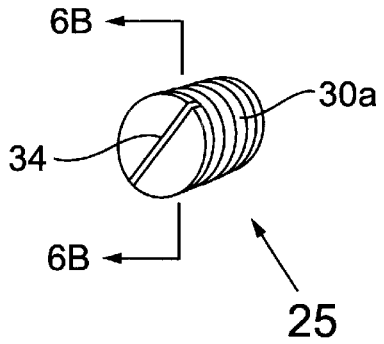
FIGS. 6A and 6B depict a perspective view and a sectional view, respectively, of a magnet or magnet assembly that is structured to be removably installed into an unoccupied magnet receptacle.
Figure 6B:
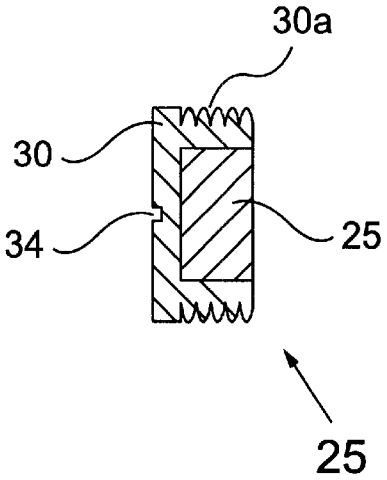

Turning again to FIG. 4, when embedding the board magnets 25 into the magnet receptacles 28 of the core 12*b*, it may be most preferable that each board magnet be sized to be snugly, yet somewhat loosely press-fitted into each magnet receptacle 28. This would enable simply structured magnets, for example disk magnets, which are not fitted into or housed within a holder/casing, to be employed. It may be noted that the arrangement of FIG. 4 may easily be modified by skilled persons so as to support the later removal and or relocating of one or more embedded board magnets 25 from the magnet receptacles 28 into which they have been embedded and installed. Alternately, as illustrated in FIGS. 6A and 6B, each magnet may be structured for being screwed into a threaded magnet receptacle 28*a*, as shown in FIG. 5, which is selected from a plurality of threaded magnet receptacles 28*a* available. Accordingly, each of the board magnets 25 may be structured, as illustrated in FIGS. 6A and 6B, with a threaded casing disposed about and fixed to at least a portion of the board magnet 25. A slot 34 is preferably included along with the required threading 30a. As such, the threaded board magnets 25 depicted in FIGS. 6A and 6B are structured for being installed into a selected threaded magnet receptacle 28*a* by rotating, say with a slotted screw driver, and being screwed into an unoccupied threaded magnet receptacle 28*a*.

It may be noted that although each display article 16 illustrated herein is magnetically held in position, when being displayed, by just two article magnets fixed to a rear facing surface, such as surface 16*db* of the article 16*d* shown in FIG. 3, this need not always be the case. It is certainly contemplated that other possible display articles 16 may employ or require a larger plurality of article magnets 24 (and corresponding, aligned board magnets 25). For example, display articles may be mounted to the presentation board 12 using 3, 4, or even larger numbers of magnet pairs 26 in accordance with the invention, which need not be employed in a linear or longitudinal arrangement.

Figure 7:
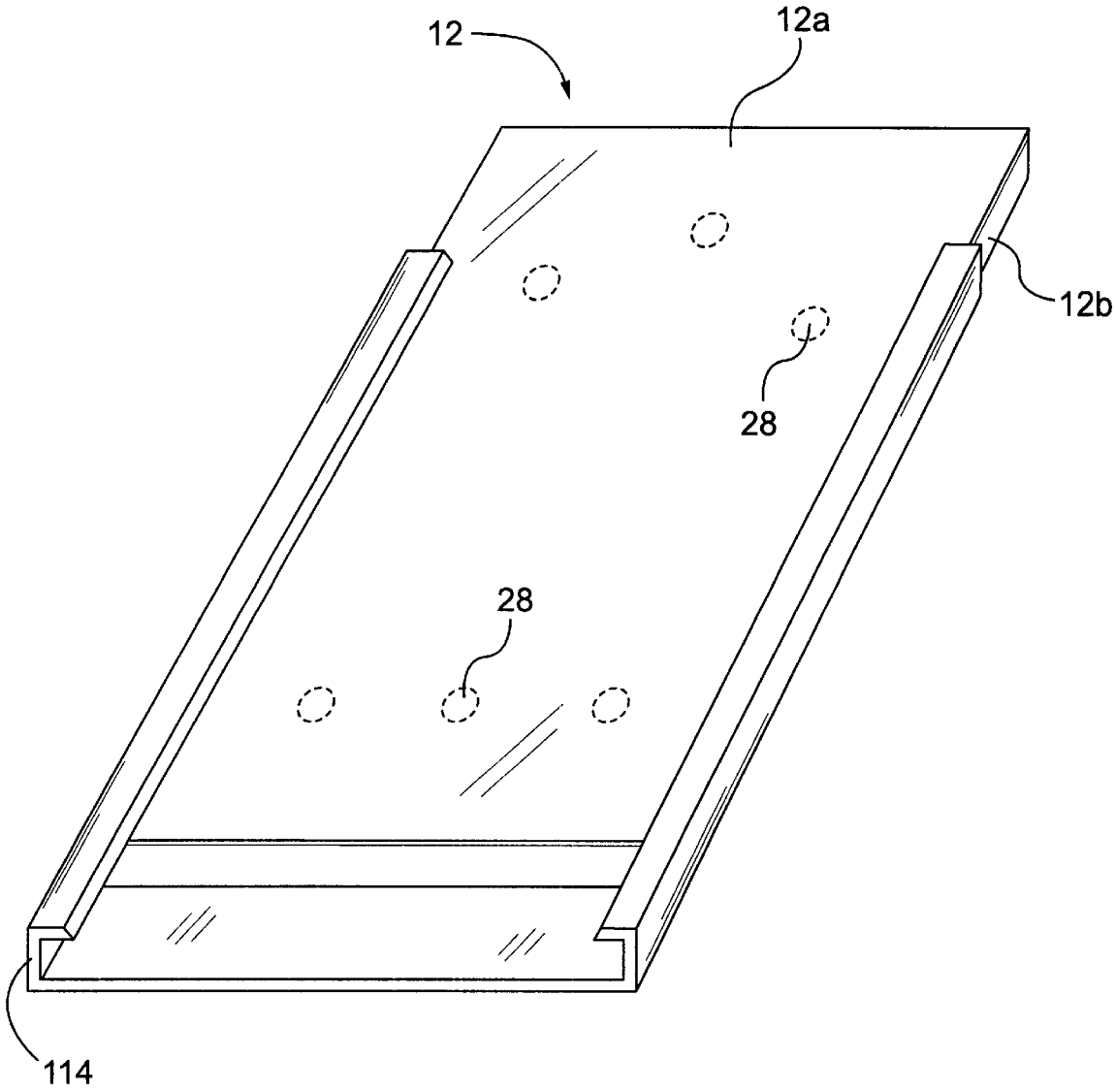
FIG. 7 provides a perspective view of yet another embodiment of a configurable magnetic presentation and display board having a slidably removable rear cover.

When considering configurable embodiments of the magnetic presentation and display board 10, there may be embodiments wherein the second sheet material 12*c* is omitted, or alternately structured to be removed. For example, as shown in FIG. 7, a slidable and removable rear cover 114 may be provided. The rear cover 114 may be slid sufficiently out of the way, or removed entirely, to provide access to a desired plurality of magnet receptacles 28/28*a*. Once the board magnets 25 are installed into the desired plurality of magnet receptacles 28/28*a*, the rear cover 114 may be slid back into a position so as to completely cover and conceal the magnet receptacles 28/28*a* there behind. The use of a rear cover 114 may be most desirable when a customer needs to handle and grasp the magnetic presentation and display board 10 of the present invention to view and inspect articles displayed thereupon. In such cases, it may also be desirable to provide friction enhancing surface features, such as knurling, grooves, etc., to aid the customer in firmly grasping the presentation board 12.

As skilled persons will understand other, possibly simpler arrangements are available for providing a rear covering surface, when needed. As an example, consider embodiments of the invention wherein there is a relatively large number of board magnets 25 employed to securely display a plurality of display articles 16. In such an embodiment a rear cover may be embodied in the form of a ferromagnetic sheet, which is held in place by the attraction of the board magnets 25 embedded within the magnet receptacles 28/28*a* of the core 12*b*. Yet other, rear covering structures are certainly possible.

In addition, it may be desirable to provide embodiments of the presentation board 12 that may be mounted or fixed to a support structure such as a display wall or a partition. For example, the removable rear cover 114 depicted in FIG. 7 may be configured with a minimal plurality of small mounting holes, knock-outs, or other suitable structures, so that the cover 114 may be fixed to a support structure at a location where a presentation board 12 is displayed. Once the cover 114 is secured to a selected structure, a presentation board may be slidably mated with the rear cover 114 for display purposes. Alternately, the rear surface of the core 12*b* may itself include mounting structures, either formed therein or fixed thereto, for enabling the presentation board 12 to fixed to or mounted upon a support structure. As such, providable wall mounted embodiments of the presentation board 12 may therefore not require a second sheet material 12*c*.

While there have been described herein a plurality of the currently preferred embodiments of the present invention, along with contemplated methods of operation and use, those skilled in the art will recognize that other and further modifications may be made without departing from the invention. For example, embodiments may be provided that have fewer magnet receptacles 28/28*a* then depicted in FIGS. 4 and 5, say with each display position having associated therewith a linear plurality of magnet receptacles 28/28*a* that may have a tight spacing for enabling the linearly defined display position to be finely adjusted to accommodate a specific display article 16. As an example, consider the linear display position established by the magnet receptacles 28 within the dotted line of FIG. 4. It may certainly be possible to emit the next row to the left of the dotted line column, resulting magnet receptacles 28 of adjacent columns having a much larger spacing then the magnet receptacles 28 of the same grouping/column.

Another modification that is contemplated may result in the merging or combining of the first sheet material 12*a* with the core 12*b*. For example, if a suitable core material is employed, such as plastic, polycarbonate resins, acrylics, etc., the magnet receptacles 28/28*a* may not be through holes, but partially drilled holes, which may be termed 'counter bores', wherein a thin bottom wall is left intact. This arrangement would eliminate the need for first sheet material 12*a*, while still supporting the close superposing and overlaying of article magnets with board magnets.

Therefore, embodiments of the present invention, including the above alterations and others providable by skilled persons, are to be considered within the scope of the magnetic presentation and display board of the present invention. Accordingly, the foregoing descriptions of the specific embodiments of the present invention have been presented for the purposes of illustration, description, and enablement. They are not intended to be exhaustive or to limit the invention to the specific forms disclosed and or illustrated herein. Obviously numerous other modifications and alterations are possible in light of the above teachings, and it is fully intended to claim all modifications and variations that fall within the scope of the appended claims provided hereinafter.

What is claimed is:

1. A magnetic presentation and display board for securely, yet removably displaying at least one display article in a pre-determined display location, the magnetic presentation and display board comprising:

a) a presentation board formed of non-ferromagnetic materials, including a first sheet material establishing the first surface and a core to which the first sheet material is fixed;

b) at least two magnet pairs provided for each display article, with each magnet pair including an article magnet, which is fixed for display purposes to a rear facing surface of a respective display article at a selected location thereupon, and a board magnet that is embedded within the core of the presentation board, behind the first sheet material, such that the board magnet will align with and be attracted to the article magnet when the display article is substantially positioned in the display location;

c) each display article thereby securely, yet removably displayed upon the magnetic presentation and display board by at least two magnet pairs, with each magnet pair formed by one article magnet and one board magnet, arranged having a magnetic attraction exerted therebetween when the display article is substantially positioned and held in the display location.

2. The magnetic presentation and display board in accordance with claim 1, wherein the presentation and display board is structured for displaying a plurality of display articles, with each display article displayed using at least two magnet pairs.

3. The magnetic presentation and display board in accordance with claim 2, wherein the presentation and display board is structured for displaying each of the display articles in a unique position, established by uniquely spacing each of the plurality of magnet pairs used for displaying each display article, thereby resulting in a mis-aligning of magnets of at least one magnet pair when the display article is not located in a correct display location.

4. The magnetic presentation and display board in accordance with claim 1, wherein a plurality of magnet receptacles are provided in the core so that each board magnet of a magnet pair may be positioned, as required, for establishing a display location in which a respective display article is to be displayed.

5. The magnetic presentation and display board in accordance with claim 4, wherein the plurality of magnet receptacles are provided in the core in a grid pattern.

6. The magnetic presentation and display board in accordance with claim 4, wherein the plurality of magnet receptacles are provided in the core in a honeycomb pattern.

7. The magnetic presentation and display board in accordance with claim 4, wherein each magnet is arranged for press fitting into a magnet receptacle when establishing a display location.

8. The magnetic presentation and display board in accordance with claim 4, wherein each magnet is arranged for being screwed into a threaded magnet receptacle selected from a plurality of threaded magnet receptacles.

9. The magnetic presentation and display board in accordance with claim 8, wherein each of the board magnets is structured with a threaded casing disposed about and fixed to at least a portion of the board magnet and configured for mating with and being installed into an unoccupied threaded magnet receptacle.

10. A magnetic presentation and display board for securely, yet removably displaying a plurality of display articles, with each display article having a substantially unique display location, the magnetic presentation and display board comprising:

a) a plurality of board magnets;

b) a plurality of article magnets, with at least two article magnets spaced and fixed to a rear facing surface of each article to be presented and displayed; and c) a presentation board sized and formed of non-ferromagnetic materials, and structured with a core having a plurality of magnet receptacles, each magnet receptacle arranged to accept and hold securely therein a board magnet;

d) the magnetic presentation and display board configurable by installing at least two board magnets for aligning with article magnets that have been fixed to a respective display article for display purposes, such that when the display article is placed upon the presentation board substantially in an intended display location, as established by the locating of the at least two board magnets, the display article is securely, yet removably held in place upon the presentation board and displayed for viewing by interested nearby individuals.

11. The magnetic presentation and display board in accordance with claim 10, wherein the presentation board is configurable and is structured for displaying each display article in a unique location upon the presentation board by establishing a unique spacing of each magnet pair employed to magnetically hold each display article in the unique location.

12. The magnetic presentation and display board in accordance with claim 11, wherein the first and second board magnets employed for each display article to be displayed are each installable within one of a plurality of available magnet receptacles, enabling the exact location of the display article to be selected and established.

13. The magnetic presentation and display board in accordance with claim 12, wherein the magnet receptacles are threaded, and each board magnet is installed into a selected magnet receptacle by rotating and screwing the magnet into the respective magnet receptacle.

14. The magnetic presentation and display board in accordance with claim 13, wherein the board magnets are installed in a threaded magnet receptacle by employing a threaded casing that is disposed about and fixed to outer surfaces of each board magnet.

15. The magnetic presentation and display board in accordance with claim 11, wherein each display position has associated therewith a linear plurality of magnet receptacles, into which at least two board magnets are installed for establishing a display location for securely displaying a display article to be displayed in the display location.

16. The magnetic presentation and display board in accordance with claim 10, wherein each article magnet is fixed to a rear facing surface of the display article at the selected location using double sided foam tape.

17. A method for securely, yet removably displaying at least one display article in a pre-selected display location upon a first surface of a magnetic presentation board, the method comprising the steps of:

a) installing a plurality of board magnets at pre-selected locations formed in a core of the magnetic presentation board, establishing the pre-selected display location;

b) fixing a plurality of article magnets, for display purposes, to spaced locations upon a rear facing surface of a display article, with a spacing of the spaced locations established for aligning the article magnets with board magnets installed at the pre-selected locations formed in the core;

c) with the installing of board magnets and attaching of matched article magnets forming magnet pairs for producing an attracting of each board and article magnet when a display article is substantially positioned in the pre-selected display location, causing the display article to be securely, yet removably displayed for viewing by interested nearby individuals.

18. The method as recited in claim 17, wherein the step of installing each board magnet involves the embedding of each board magnet into an unoccupied magnet receptacle formed at a respective pre-selected location.

19. The method as recited in claim 17, wherein the step of fixing a plurality of article magnets to a rear facing surface of each display article includes fixing two article magnets to the display article using double-sided foam tape.

* * * * *